US005269177A

United States Patent [19]

Miggins et al.

[11] Patent Number: 5,269,177

[45] Date of Patent: Dec. 14, 1993

[54] APPARATUS AND METHOD FOR DETERMINING THE CENTER OF PERCUSSION ("SWEET SPOT") FOR BASEBALL BATS AND OTHER OBJECTS

[76] Inventors: Lawrence E. Miggins, 2405 Kingston Dr., Houston, Tex. 77019; Louie A. Galloway, III., 10174 Beekman Pl., Houston, Tex. 77043; Patrick O. Braden, P.O. Box 97, St. Lucia

[21] Appl. No.: 871,936

[22] Filed: Apr. 21, 1992

[51] Int. Cl.[5] ..... A63B 53/00

[52] U.S. Cl. ..... 73/65.03; 73/65.01

[58] Field of Search ..... 73/65.03, 65.01; 273/26 B, 77 A, 77 R, 80 A, 72 A, 29 A

[56] References Cited

U.S. PATENT DOCUMENTS

| | | | |
|---|---|---|---|
| 3,785,197 | 1/1974 | Finn | 73/65.03 |
| 4,203,598 | 5/1980 | Stuff et al. | 273/77 A |
| 4,674,324 | 6/1987 | Benoit | 73/65.03 |
| 4,834,370 | 5/1989 | Noble et al. | 273/72 A |
| 4,921,574 | 9/1981 | Frolow | 273/73 C |

OTHER PUBLICATIONS

Beiser, Arthur, *Physics*, The Benjamin/Cummings Publishing Co., Inc., Menlo Park, Calif., 1973, ISBN 0-84-66-0521-9 (pp. 274-276).

Serway, Raymond A., *Physics for Scientists and Engineers With Modern Physics*, Saunders College Publishing, Philadelphia, Pa., Third edition, 1986, ISBN 0-0-3-031353-8 (pp. 337-338).

Brochure excerpts pp. 34-36 of Pasco Scientific.

*Primary Examiner*—Donald O. Woodiel
*Assistant Examiner*—Elizabeth L. Dougherty
*Attorney, Agent, or Firm*—Pravel, Hewitt, Kimball & Krieger

[57] ABSTRACT

Apparatus and method is provided for determining the subjective sweet spot of a baseball bat, softball bat or other object of percussion. The subjective sweet spot is determined by first measuring the period of oscillation of the baseball bat or other object of percussion through an angular displacement of five degrees or less. Thereafter, a particular formula is utilized for determining the subjective sweet spot and the sweet spot is marked on the baseball bat for use by the hitter. The principles of this invention may be utilized on other objects of percussion such as softball bats, golf clubs and the like.

6 Claims, 2 Drawing Sheets

APPARATUS AND METHOD FOR DETERMINING THE CENTER OF PERCUSSION ("SWEET SPOT") FOR BASEBALL BATS AND OTHER OBJECTS

FIELD OF THE INVENTION

This invention relates to the determination of the subjective sweet spot or center of percussion of a baseball bat, softball bat or other object of percussion such as a golf club.

BACKGROUND OF THE INVENTION

When a baseball player hits a prodigious home run, he is sometimes amazed at the apparent ease with which he accomplished this feat. He may even feel that he could have swung harder than he did because it seemed so effortless to hit the ball that far. In actuality, the baseball player has not swung that easily but rather he has hit the ball at the "sweet spot" or center of percussion of the baseball bat. The center of percussion of a baseball bat or other object is, by definition, the point at which the bat can hit the baseball with the bat experiencing little or no reaction force at the hands of the batter. Stated another way, the sweet spot or center of percussion is the point at which a baseball bat can collide with a baseball while causing the minimum amount of reactionary vibration at the hands of the batter.

While it has been recognized among scientists that the center of percussion is present in a baseball bat, insofar as known, there has been no effort to physically determine the center of percussion for a baseball bat in any practical and convenient manner. For example, in the textbook *Physics,* Second Edition by Arthur Beiser, it is recognized that a baseball bat has a center of percussion, and while the Physics book contains a number of formulas relating to center of percussion, there is no effort to determine the center of percussion for a particular baseball bat. Similarly, the textbook *Physics for Scientists & Engineers With Modern Physics,* Third Edition, by Raymond A. Serway, recognizes that the compound or physical pendulum effect is present in every rigid body suspended from a fixed axis; however, there is no teaching of determining the center of percussion for a baseball bat.

Detection and marking of the sweet spot for a baseball bat could have a number of advantages. For example, having the actual sweet spot for a particular baseball bat marked on the bat would provide additional emphasis to the batter to try to hit the ball as near to the sweet spot as possible. Further, it is likely that a marked sweet spot for a bat would help a batter to align himself with respect to the plate.

SUMMARY OF THE INVENTION

It is an object of this invention to provide apparatus and method for determining the subjective sweet spot or center of percussion for a baseball bat, softball bat or other object of percussion such as a golf club. The sweet spot is determined in the following manner. Firstly, the bat is gripped by a potential user so that a center of rotation may be marked. Then, the bat is mounted for pivoting or rotation in a substantially vertical plane so that the period (time for a cycle) of the bat may be determined. It has been further determined that it is most desirable to calculate the period for a cycle of rotation of five degrees or less. Once that period T is determined, the length L of the sweet spot from the center of rotation is calculated by the following formula:

$$L=24.81\ T^2$$

where L is the length in centimeters and T is period in seconds.

In following these steps, the sweet spot for any bat or other object of percussion such as a softball bat may be determined. It should be understood that this description is intended as a summary only, and that the full description of the preferred embodiment will follow and the scope of the protection sought will be set forth in the claims.

DESCRIPTION OF THE PREFERRED EMBODIMENT

Figure 2:
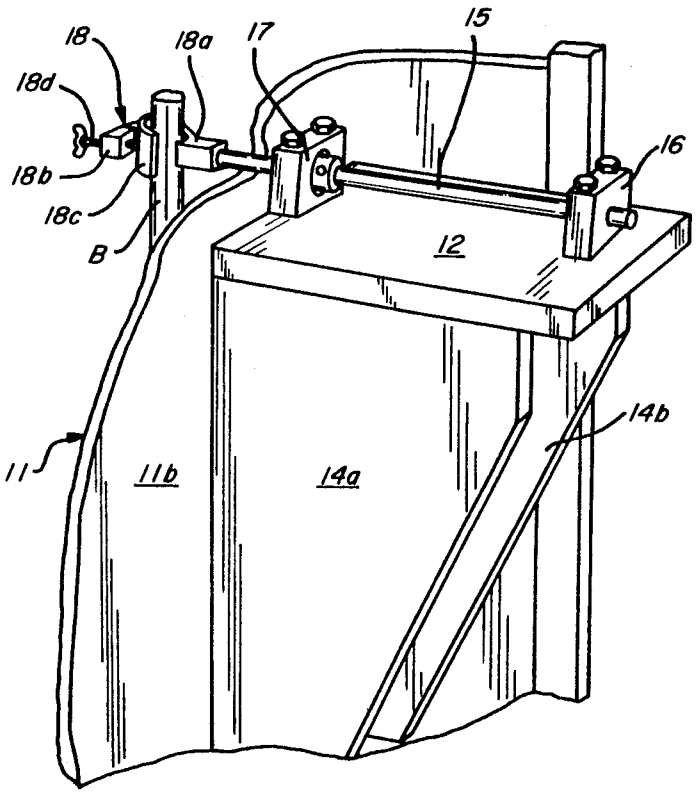
FIG. 2 is a view from the rear of the apparatus of FIG. 1 illustrating the mounting of the baseball bat for rotation about its anticipated center of rotation.
Figure 1:
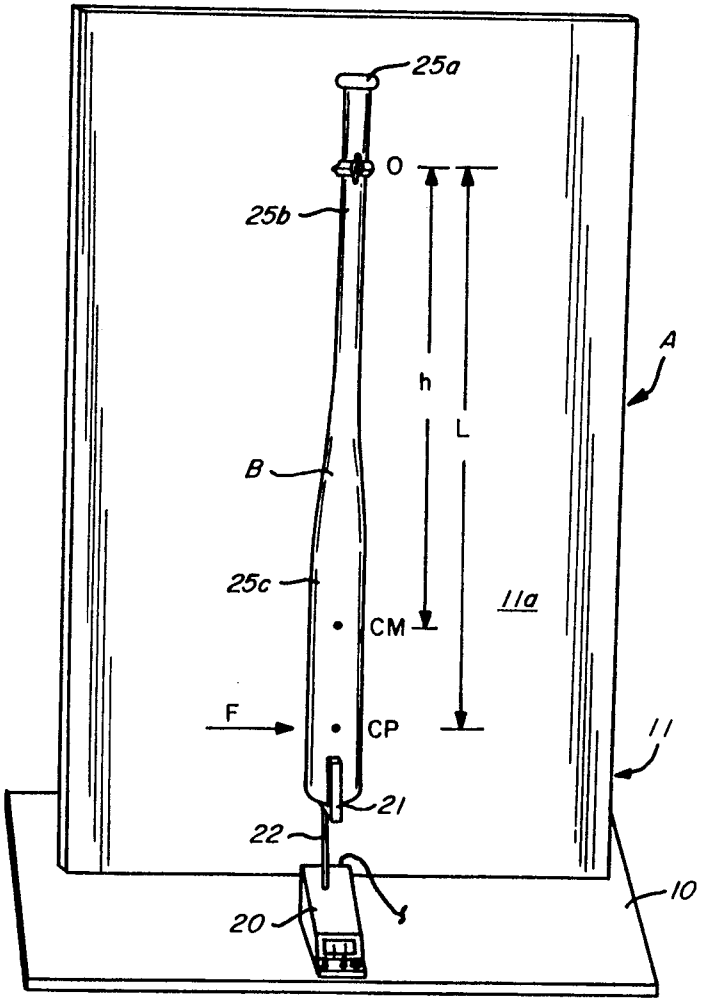
FIG. 1 is a front view of one embodiment of apparatus of this invention for determining the period of a particular bat.

Referring to the drawings, the apparatus A is provided for determining the period of a cycle of rotation of the baseball bat B so that such value for the period may be utilized in a formula to determine and ultimately mark the subjective sweet spot designated as CP (for Center of Percussion) for a baseball bat. The apparatus A includes a base 10 having mounted thereon a vertical wall member 11 which may be attached to the base 10 by any suitable means such as a series of supports (not shown) well known within the skill of the art. It should be understood at the outset that, while the preferred embodiment of this invention is described in terms of the baseball bat B, that the principles of this invention may be utilized on other types of bats such as softball bats as well as on other types of devices which are objects of percussion such as golf clubs. It should be further understood that the various types of objects of percussion such as the baseball bats may be made of various components such as wood, metal, graphite or other materials.

The apparatus A includes a means for mounting a baseball bat B for rotation about a horizontal axis of rotation O. This mounting means includes a rearwardly directed, horizontal platform 12 which is mounted on the rear side of the vertically extending wall 11. The platform 12 is supported by two generally triangularly shaped support members 14*a* and 14*b* which are mounted onto the backside 11*b* of the wall 11. A shaft 15 is mounted in a horizontal axis onto the platform 12 by bearing block assemblies 16 and 17. The shaft 15 extends through the bearing block assemblies, and through an opening in the vertically extending wall 11 to the front side 11*a* of the vertically extending wall 11. A clamp assembly 18 is mounted onto the front end of the shaft 15 in order to secure the upper end of the baseball bat B. The clamp assembly may comprise any suitable components for holding the baseball bat B without damaging it. The clamp 18 includes a first member 18*a* having an inside curved surface for receiving the curved surface of the baseball bat and a second stationary member 18*b* which includes an adjustable section 18*c* which is mounted for adjustable positioning utilizing the screw member 18*d* which extends through the stationary member 18*b*. In this manner, the baseball bat B can be firmly placed in position at its center of rotation by screwing tightly the adjustable, curved member 18*c* into position against the baseball bat B, which is already seated against stationary clamp element 18*a*.

A measurement means generally designated as 20 is positioned on the base member 10 and extends upwardly to receive the free swinging lower end of the baseball bat B. In the preferred embodiment of this invention, the measurement means 20 is provided to measure the time that it takes for the lower end of the baseball bat B to swing through a cycle of five degrees or less of angular displacement. In the preferred embodiment of this invention, the measurement means 20 is a Pasco Model ME-9215A or ME-9206A Photogate Timer manufactured by Pasco Scientific of California. The Pasco Photogate Timer ME-9215A includes a built in memory function and variable resolution for each of four timing modes, one of which is known as "Pendulum." In the Pendulum timing mode, the photogate head, a generally U-shaped member 21, may be positioned to time the period of oscillation of the baseball bat B. The photogate 21 is positioned in direct vertical alignment with the center of rotation of the shaft 15, which is also the center of rotation O for the baseball bat B. The photogate head is held in position by a vertically extending rod 22 which mounts into the measurement unit 20. The Pasco measurement unit 20 includes the necessary hardware and software to accomplish measurement of the period of oscillation of the baseball bat through an angular displacement of five degrees or less. The Photogate Timer 20 is provided to measure the period of time T for one complete oscillation of the lower end of the baseball bat B about the center of rotation O through an angular displacement of five degrees or less.

DETERMINATION OF FORMULA FOR SUBJECTIVE SWEET SPOT

Step 1. Consider a baseball bat lying on a frictionless, horizontal table.

Step 2. Imagine a horizontal force F applied at some arbitrary point on the surface of the bat and perpendicular to the longitudinal axis of the bat.

Step 3. Due to the action of the force F, the bat will, in general, execute a complex combination of linear acceleration and angular acceleration about some fixed point in space, on a line concentric with the longitudinal axis of the bat.

Step 4. We provide the following parameters:

CM = the center of mass of the bat;

M = the mass of the bat in grams;

h = the distance from point O to the center of mass in centimeters;

x = the distance from point O to an arbitrary point on the axis of the bat in centimeters;

$\alpha$ = the angular acceleration of the bat about point O in radians per second squared;

L = the distance from point O to the point on the axis of the bat at which the force is applied in centimeters.

Then, according to the laws of physics, the following mathematical formulas are correct:

$$Torque = FL \tag{1}$$

Torque is the torque exerted on the bat about point O, due to the force F. Torque will be measured in dyne-centimeters when F is measured in dynes and L is measured in centimeters.

$$\text{Torque} = I\alpha \tag{2}$$

I is the moment of inertia of the bat about point O measured in gram-centimeters squared; and $\alpha$ is the angular acceleration of the bat about point O as described above measured in radians per second squared.

$$a_x = x\alpha \tag{3}$$

$a_x$ is the linear acceleration of a point on the axis of the bat at distance x (measured in centimeters), from point O measured in centimeters per second squared.

Step 5. Now according to Newton's Second Law of Motion, the relationship between the force F, the mass m and the linear acceleration of the center of mass of the bat $a_{cm}$, is given by:

$$F = ma_{cm} \tag{4}$$

but according to equation (3), the linear acceleration at CM, the center of mass is:

$$a_{cm} = h\alpha \tag{5}$$

since the distance from point O to the center of mass of the bat is h.

Substituting equation (5) into equation (4) we have:

$$F = mh\alpha \tag{6}$$

Substituting equation (6) into equation (1) we have:

$$\text{Torque} = mh\alpha L \tag{7}$$

and finally using equation (2) with equation (7) we have:

$$mh\alpha L = I\alpha$$

or $$mhL = I$$

or $$L = I/(mh) \tag{8}$$

Step 6. Equation (8) allows one to calculate the distance of point O from a point on the axis of the bat at which the line of action of the force F intersects the axis of the bat which we now call point CP. Equation (8) requires knowledge of I, m, and h to calculate L.

Step 7. By means of a measurement, the distance L can be calculated without prior knowledge of the parameters I, m, and h. To begin, divide both sides of equation (8) by g, the local acceleration of a free-falling object due to gravity. Let g be measured in centimeters per second squared. We have:

$$L/g = I/(mgh) \tag{9}$$

Step 8. Take the square root of both sides of equation (9). We have:

$$\sqrt{L/g}=\sqrt{I(mgh)} \quad (10)$$

Step 9. Multiply both sides of equation (10) by the value $2\pi$. We have:

$$2\pi\sqrt{L/g}=2\pi\sqrt{I/(mgh)} \quad (11)$$

Step 10. The right side of equation (11) is recognized by physicists and engineers as the period of a physical pendulum for small angular oscillations. For our purposes, the bat is a physical pendulum and if the bat is suspended vertically and allowed to swing or oscillate through small angular oscillations about a horizontal axis through the point O then the period T measured in seconds (meaning the time in seconds for one complete oscillation will be given by both sides of equation (11). This relationship is known to be accurate, so long as the maximum angular excursion of the bat from the vertical during the oscillation is less than five degrees.

Step 11. If one measures T for a given bat as described above, then according to equation (11)

$$2\pi\sqrt{L/g}=T \quad (12)$$

Step 12. Squaring both sides of equation (12) we have:

$$4\pi^2L/g=T^2 \quad (13)$$

Step 13. Finally, multiplying both sides of equation (13) by the quantity $g/(4\pi^2)$, we have:

$$L=gT^2/(4\pi^2) \quad (14)$$

Thus, if one knows the local acceleration due to gravity g, and measures T about point O, L can be easily calculated and the "sweet spot" of the bat can be accurately located.

Step 14. In Houston, Texas, to a very good approximation, g=979.3 centimeters per second squared. Thus, combining all of the fixed numbers in equation (14) we have the simple formula that in Houston, Tex., $$L=24.81T^2 \quad (15)$$

Where L will be in centimeters when T is in seconds. If one measures T accurate to 0.001 seconds, then for almost any commonly used baseball bat, L can be calculated accurate to 0.1 centimeters or better.

The known fact that equation (8) is valid may be found on pages 268-269 of Arthur Beiser's *Physics*, Cummings Publishing Co., Menlo Park, Calif., 1973, ISBN 0-8466-0521-9.

The known fact that the right hand side of equation (11) represents the period of a physical pendulum, i.e. a baseball bat, may be found on page 337 of Raymond A. Serway's *Physics for Scientists and Engineers With Modern Physics*, Saunders College Publishing, Philadelphia, Third Edition, 1986, ISBN 0-03-031353-8.

METHOD OF DETERMINATION OF SUBJECTIVE SWEET SPOT UTILIZING APPARATUS A

The baseball bat B is first gripped by the batter at the point of natural gripping for the batter. The batter may assume a position for full hitting where the batter's hands are near knobbed end 25*a* of the baseball bat B or the batter may assume a more choked up position where the hands are moved further down the handle area 25*b* toward the hitting area 25*c*. Once the batter's hands have assumed the desired position, a point O is marked between the batter's hands. The point O is to be the anticipated center or rotation of the bat. The bat B is then mounted with point O being in alignment with the shaft 15 so that the center of rotation of the baseball bat is identical to the rotation axis shaft 15. The clamp assembly 18 is adjusted so that the bat is firmly held without damage. The U-shaped photo head 21 is positioned to receive the lower end of the bat B in a direct vertical position. The Pasco Scientific Photogate Timer is then activated and placed in a special Pendulum mode. The bottom end of the baseball bat B is then rotated to an angular displacement from vertical of five degrees or less and let go so that the lower end of the baseball bat travels through a cycle. In the Pendulum mode, the Photogate Timer 20 is capable of measuring the time it takes for this one oscillation of the baseball bat B.

That period of oscillation T is then applied in the formula:

$$L=24.81T^2.$$

After the distance L is determined in centimeters, that distance is marked off from the center of rotation O of the bat downwardly such that the subjective sweet spot CP is actually marked on the bat.

It is within the scope of this invention to mark more than one subjective sweet spot on the same bat, to accommodate, for example, more than one gripping point of the particular hitter. For example, the batter may want to have both a full swing position and a choked position sweet spot marked on his or her bat.

In a reverse application of this invention, if one knows where the center of percussion ("sweet spot") of the object is located, then one can use this invention to locate the position (such as on the handle) at which the object should be held so that the desired center of percussion is obtained. For example, one knows that the center of percussion on a golf club is to be the center of the head such as with a wood or an iron. If the club is then pivoted about a horizontal axis through the center of percussion (center of the head) and allowed to oscillate through a maximum angular excursion of five degrees, and the handle of the club swings through the U-shaped photogate of the Pasco timer, the same formula correctly predicts the distance from the center of percussion to a point on the handle at which the club should be held by the golfer in order to deliver maximum energy to the golf ball, by measuring the period (time for one cycle) of the club in seconds and calculating the distance L (in centimeters).

Figure 4:
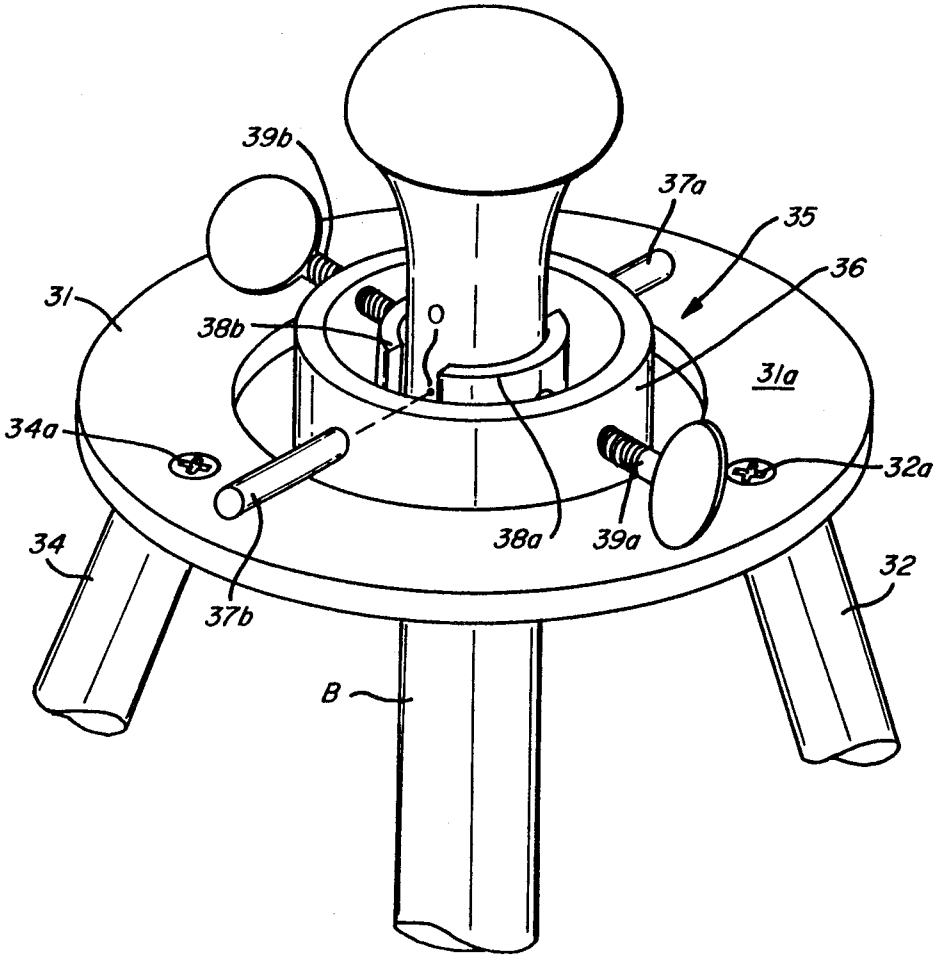
FIG. 4 is an enlarged view of the upper mounting assembly of the embodiment of FIG. 3.
Figure 3:
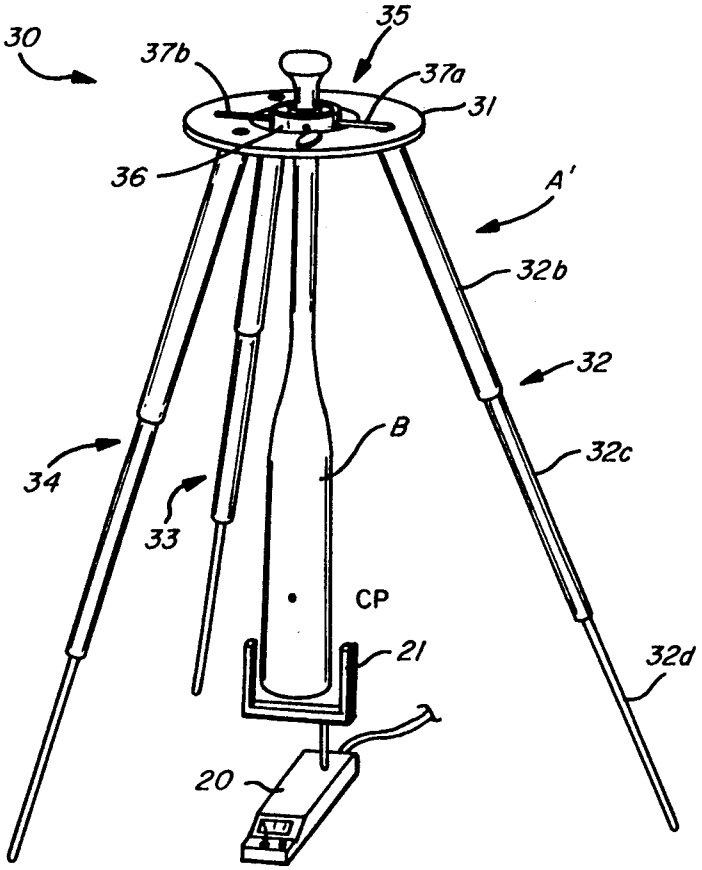
FIG. 3 is a view in perspective of an alternative and preferred embodiment for mounting the baseball bat for rotation about its anticipated center of rotation.

The apparatus A' of FIGS. 3 and 4 is an alternative and preferred embodiment for the purposes of mounting and measuring the cycle of rotation of the bat or other object. The actual means for mounting the bat B about a horizontal axis of rotation O is identified by the number 30.

The mounting means 30 includes an annular mounting plate 31 which is supporting by three telescoping legs 32-34. Each of the legs 32-34 are attached to the annular mounting plate or platform 31 by any suitable means such at set screws 32*a* and 34*a* illustrated in FIG. 4. Each of the telescoping legs 32-34 are identical in structure and thus only leg 32 will be described in any detail. Referring to FIG. 3, the telescoping leg 32 includes a stationary top section 32*b* which is actually attached by set screw 32*a* to the annular platform 31.

The top section 32*b* mounts for slidable movement therein a middle telescoping section 32*c* which in turn mounts and receives slidable, telescoping section 32*d*. One of the purposes of the telescoping legs is to provide that the apparatus A' be at least partly collapsible for purposes of travel and storage. Further, the adjustability of each of the telescoping legs 32–34 provides that the annular mounting platform 31 can be adjusted to a level, horizontal position regardless of the surface of the floor on which the apparatus A' is positioned.

The annular platform 31 serves as part of a mounting assembly generally designated as 35 which mounts the bat B at its anticipated center of rotation O as previously described. The mounting assembly 35 includes a circular or annular mounting ring having extending diametrically therefrom two arms 37*a* and 37*b*. The arms 37*a* and 37*b* are connected to the ring 36 by any suitable means. For example, in the embodiment shown, the arms 37*a* and 37*b* each terminate in a threaded section, not shown, which is threaded into suitably compatible threaded holes (not shown) in the ring 36. In this manner, the ring 36 is mounted onto the annular platform 31 for rotation in a horizontal axis so that the bat B can be mounted for rotation about such a horizontal axis as defined by the arms 37*a–b*.

In order to mount the bat B for rotation with the ring 36, two circular mounting segments 38*a* and 38*b* are mounted by screws 39*a* and 39*b* which extend through the ring 36 into attachment with the mounting segments 38*a–b*.

In operation and use, the baseball bat B or other object of percussion is mounted at its anticipated center of rotation O by adjustment of the circular mounting segments 38*a* and 38*b* into engagement with the bat at center of rotation O. The bat B with the clamped ring 36 is positioned onto the annular platform 31 so that the arms 37*a–b* rest on the upper surface of the platform 31. The bat B is then ready to be rotated about the axis O in a horizontal plane provided by the annular surface 31*a* of the annular platform 31.

The Pasco Photogate Timer 20 and photogate head 21 is positioned to time the period of oscillation of the baseball bat as previously described.

The center of percussion locator method and apparatus of this invention is applicable to other types of percussion/sportsinstruments such as golf clubs, tennis racquets, racquet-ball racquets and the like. The method for determining the center of rotation for a golf club is modified from the methods previously described (It is the center of rotation that must be found for the golf club since the center of percussion is already marked on the golf club head). The Apparatus A' of FIGS. 3–4 is firstly slightly modified. The circular segments 38*a* and 38*b* are removed so that the ends of the set screws 39*a* and 39*b* are adapted to directly engage the head of the golf club. Further, the ring 36 may be open at one side in order to form a yoke. The first step is to mount the golf club by the head with the screws 39*a–b* being aligned with the center of percussion that is already marked on the club. This allows the golf club to hang by its shaft at a certain angular position with respect to vertical. Once that position of equilibrium is reached, a second yoke and screw set are attached to the golf club head, but this time the line of the screws is rotated 90 degrees with respect to the prior alignment with the sweet spot but the line of the set screws still extends through the line extending the sweet spot through the club head. Then the club is allow to rotate through a period of 5 degrees in the same general direction as the club is swung during play so that the period can be determined. Once the period is determined, the distance from the sweet spot to the center of rotation can be measured on the from the club head center of percussion down the shaft and the center of rotation marked.

Having described the invention above, various modifications of the techniques, procedures, material and equipment will be apparent to those in the art. It is intended that all such variations within the scope and spirit of the appended claims be embraced thereby. For example, the Pasco Scientific Photogate Timer may be programmed utilizing a suitable chip to contain the necessary formula for providing an automatic readout of the subjective sweet spot without having to do any manual calculations. It is contemplated that the apparatus and method of this invention may be utilized on any device utilized as an object of percussion having some central axis of rotation such as the various devices referred to herein as well as other devices not referred to.

We claim:

1. Apparatus for determining the center of percussion or "sweet spot" of a baseball bat including:
   - means for mounting a baseball bat about an axis of rotation, said baseball bat rotates about said axis of rotation through a cycle of oscillation;
   - said axis of rotation of said baseball bat being located approximately at one end thereof;
   - measurement member positioned about said other end of said baseball bat; and a timing circuit positioned in said measurement member and in a calculation network for measuring the period of oscillation of said baseball bat;
   - said means for mounting including:
   - a frame assembly including a base and a vertically extending frame;
   - a clamp assembly for gripping said one end of said baseball bat; and
   - a shaft mounted onto said vertically extending frame for rotation with respect thereto, said shaft supporting said clamp assembly such that said baseball bat is mounted for rotation in a substantially vertical plane.

2. The apparatus set forth in claim 1 wherein said measurement member is:
   - a substantially U-shaped member.

3. The apparatus set forth in claim 1 wherein said means for mounting further includes:
   - an annular platform having attached thereto a plurality of telescoping legs so that the height and levelness of the annular platform is adjustable;
   - a mounting ring and pivot arms attached to said mounting ring, said mounting ring mounted for pivotal movement by said arms engaging the annular platform; and
   - a clamp assembly mounted with said mounting ring for engaging and holding said baseball bat or other object of percussion so that the period of oscillation is measured.

4. A method of determining the sweet spot for a baseball bat comprising the steps of:
   - locating the area for gripping said baseball bat to determine the center of rotation;
   - mounting said baseball bat for oscillation in a vertical plane;
   - measuring the period of oscillation of said baseball bat through an angular displacement of five degrees or less to obtain a value;

applying said value for the period of rotation T in the following formula:

$$L=24.81\ T^2$$

marking said baseball bat a distance L from said center of rotation, which marking indicates the subjective sweet spot or center of percussion.

5. The method of claim 4, including the step of:

locating the center of rotation between the position of the two hands of a particular batter or other swinger.

6. The method of claim 4, wherein the period of oscillation is measured by the following step:

utilizing a digital measurement instrument including a U-shaped photogate head positioned under the swinging end of said baseball bat or other object of percussion.

* * * * *